United States Patent [19]

Majewski

[11] 4,351,444

[45] Sep. 28, 1982

[54] BOWL FOR MAINTAINING LIQUIDS AND SOLID FOODS SEPARATE

[76] Inventor: Edward Majewski, 81 Rae Ave., Staten Island, N.Y. 13102

[21] Appl. No.: 98,512

[22] Filed: Nov. 29, 1979

[51] Int. Cl.[3] ..... B65D 21/02; B65D 25/04; A47G 19/02

[52] U.S. Cl. ..... 220/20; 220/23.83; 220/23.86

[58] Field of Search ..... 220/20, 23.83, 23.86

[56] References Cited

U.S. PATENT DOCUMENTS

| | | | |
|---|---|---|---|
| 766,427 | 8/1904 | Growell | 220/20 |
| 1,272,996 | 7/1918 | Poschadel | 220/20 |
| 2,207,417 | 7/1940 | Smith | 220/20 |
| 2,843,287 | 7/1958 | Finley | 220/20 |

FOREIGN PATENT DOCUMENTS

| | | | |
|---|---|---|---|
| 1505479 | 11/1967 | France | 220/20 |

*Primary Examiner*—George E. Lowrance

*Attorney, Agent, or Firm*—Hopgood, Calimafde, Kalil, Blaustein & Judlowe

[57] ABSTRACT

There is disclosed a bowl for simultaneously containing solid and liquid edible substances while maintaining the solid and liquid edible substances separate. This bowl comprises a body portion and tilting means. The body portion has a bottom and side walls which are preferably circular and at least one ridge attached to a portion of the upper side of the bottom of the bowl. Preferably a plurality of these ridges are employed. The means for tilting the body portion are such that the section of the body portion which contains a greater number of ridges is higher than the section of the body portion which contains a smaller number of ridges. The bowl may be used, for example, for keeping cereal and milk or cream separate, thus maintaining the crispness of the cereal.

5 Claims, 5 Drawing Figures

BOWL FOR MAINTAINING LIQUIDS AND SOLID FOODS SEPARATE

BACKGROUND OF THE INVENTION

1. Field of the Invention

This invention relates to bowls useful for containing liquid and/or solid edible substances. More particularly, this invention relates to bowls which are constructed so as to simultaneously contain solid and liquid edible substances yet maintain the solid and liquid edible substances separate.

2. Summary of the Prior Art

Bowls which are useful for containing liquid and solid edible substances are, of course, well known. Furthermore, cereal dishes are known which are designed to contain cereal and milk at the same time while preventing the objectionable soaking of the cereal in the milk. See, e.g., U.S. Pat. Nos. 876,808 and 1,379,549. Other dishes and bowls are disclosed in U.S. Pat. Nos. 922,495; 1,100,298; and 2,352,684, as well as U.S. Pat. Nos. D 38,779; D 43,656; D 150,288; D 168,283; D 199,072; D 221,177; and D 238,739.

The search has continued for new and improved bowls, such as cereal bowls which are constructed so as to simultaneously contain solid and liquid edible substances, yet maintain those solid and liquid edible substances separate. This invention was made as a result of that search.

OBJECTS AND SUMMARY OF THE INVENTION

Accordingly, it is a general object of the present invention to provide a bowl which can simultaneously contain solid and liquid edible substances.

A more specific object of the present invention is to provide a bowl which can simultaneously contain solid and liquid edible substances, yet maintain those substances separate.

Other objects and advantages of the present invention will become apparent from the following summary of the invention and description of the preferred embodiments of the invention.

The present invention provides a bowl for simultaneously containing solid and liquid edible substances while maintaining the solid and liquid substances separate. The bowl comprises a body portion and tilting means. The body portion has a bottom and side walls and at least one ridge attached to a portion of the upper side of the bottom. The means for tilting the body portion are such that the section of the body portion which contains a greater number of ridges is higher than the section of the body portion which contains a smaller number of ridges.

DESCRIPTION OF THE PREFERRED EMBODIMENTS

Figure 1:
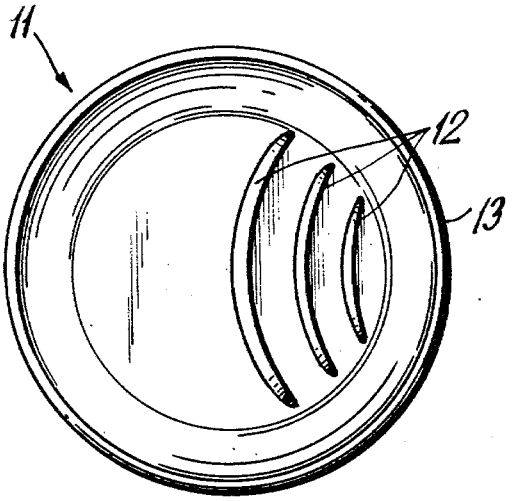
FIG. 1 is a plan view of the bowl of the present invention.
Figure 2:
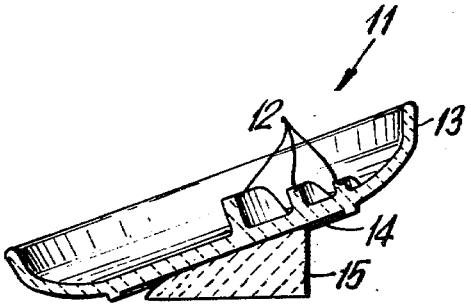
FIG. 2 is a cross-sectional view of the bowl of the present invention with tilting means attached.

The present invention provides a bowl for simultaneously containing solid and liquid edible substances while maintaining the solid and liquid edible substances separate. The bowl comprises a body portion 11 and means for tilting the body portion such as wedge 15. Body portion 11 contains a bottom 14 and side walls 13 as well as one or more ridges 12 which are attached to a portion of the upper side of bottom 14 of body portion 11. It is preferred to use a plurality of ridges. When a plurality of ridges is employed, the ridges increase in height as the center of the bowl is approached. Preferably, ridges 12 also increase in length as the center of the bowl is approached. Furthermore, it is preferred that these ridges do not connect with the side walls 13 of body portion 11. In a preferred embodiment of the present invention, side walls 13 are circular.

Means 15 for tilting body portion 11 are such that the section of body portion 11 which contains a greater number of ridges 12 is higher with respect to a horizontal plane than that section of body portion 11 which contains a smaller number of ridges 12. The tilting means is preferably a wedge 15 which may be either attached or detached from bottom 14 of body portion 11.

The body portion and tilting means may be made of any material known to those skilled in the art. Such materials include plastic, china, stoneware, earthenware, etc.

Figure 3:
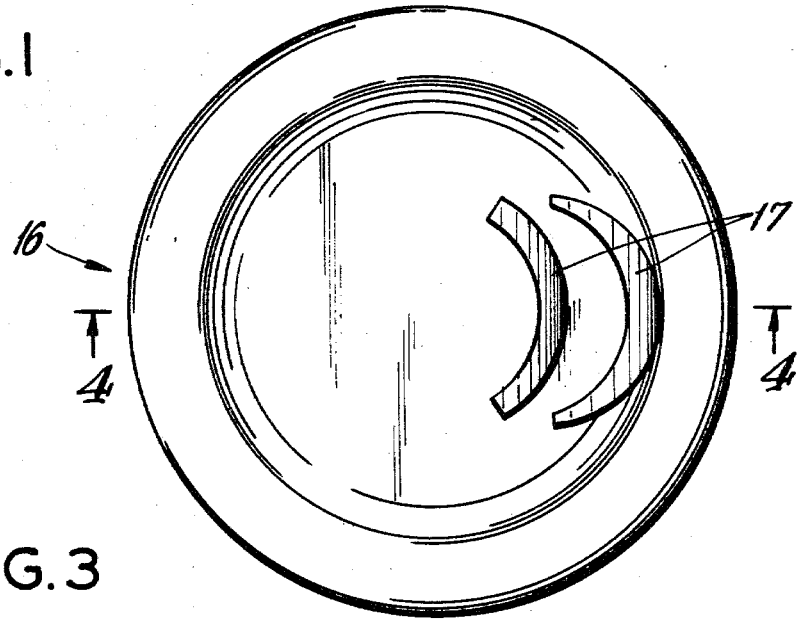
FIG. 3 is a plan view of the plate used as a tilting means in the present invention.
Figure 4:
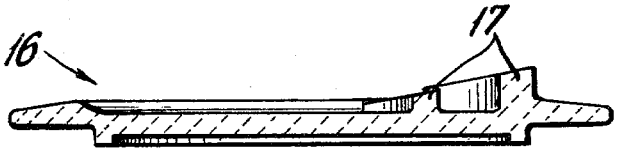
FIG. 4 is a cross-sectional view of the plate of FIG. 3.
Figure 5:
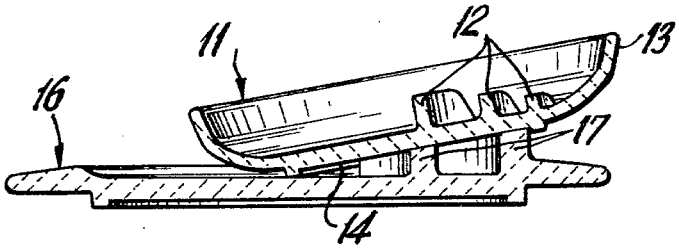
FIG. 5 is a cross-sectional view of the plate of FIGS. 3 and 4 with the bowl of FIGS. 1 and 2.

In a particularly preferred embodiment of the present invention, there may be used as the tilting means a plate 16 which contains one or more ridges 17. Preferably, there is employed a plurality of these ridges which are oriented parallel to one another and which increase in length and height as the perimeter of plate 16 is approached. Plate 16 with ridges 17 is illustrated in FIGS. 3 and 4. The outside diameter of plate 16 is preferably somewhat larger than the outside diameter of bowl 11 so that bowl 11 rests inside plate 16. Plate 16 with bowl 11 in tilted position is shown in FIG. 5 where ridges 12 of bowl 11 are aligned with ridges 17 of plate 16. Bowl 11 is tilted so that cereal may be placed on the ridges and cream or milk may be placed in the lower section of the bowl without mixing of the two.

When one wishes to eat the cereal, one may simply spoon the cereal and dip it into the milk or cream. In that way, one has the advantage of eating cereal with milk or cream, but not the disadvantage of the cereal losing its crispness and becoming soggy over a period of time.

Although the bowl has been described in detail as useful for separating cereal and milk or cream, it may be used generally for maintaining any solid and liquid foods separate.

The principles, preferred embodiments, and modes of operation of the invention have been described in the foregoing specification. The invention which is intended to be protected herein, however, is not to be construed as limited to the particular forms disclosed, since these are to be regarded as illustrative rather than restrictive. Variations and changes may be made by those skilled in this art without departing from the spirit of the invention.

I claim:

1. A bowl for simultaneously containing solid and liquid edible substances while maintaining said solid and liquid edible substances separate, said bowl comprising (a) a body portion which has a bottom and at least one side wall for containing said substances within said bowl;

(b) means for tilting said body portion such that the underside of said body portion forms an acute angle with a horizontal plane and said tilting means comprises a plate whose outer diameter is greater than the outside diameter of said bowl, said plate containing a plurality of ridges which are oriented paralled to one another and which increase in length and height as the perimeter of said plate is approached so that said bowl rests on said ridges and inside said plate on which said bowl may be placed; and (c) at least one ridge attached to the upper side of and extending at least partically across said bottom in such a way as to prevent admixture of said solid and liquid substances when said substances are placed on said upper side of said bottom portion.

2. The bowl of claim 1 wherein said bowl contains a plurality of ridges oriented parallel to one another.

3. The bowl of claim 2 wherein said ridges increase in height as the center of said bowl is approached.

4. The bowl of claim 1 wherein said bowl is made of a member selected from the group consisting of plastic, china, stoneware, and earthenware.

5. The bowl of claim 1 wherein said side walls are circular.

* * * * *